US005203182A

United States Patent [19]

Wiriath

[11] Patent Number: 5,203,182

[45] Date of Patent: Apr. 20, 1993

[54] ARTICLES OF JEWELRY AND PROCESS FOR MANUFACTURING SAME

[75] Inventor: Bauhs Wiriath, Paris, France

[73] Assignee: OR-EST S.A., Erstein, France

[21] Appl. No.: 749,916

[22] Filed: Aug. 26, 1991

[51] Int. Cl.[5] ..... A44C 25/00

[52] U.S. Cl. ..... 63/2; 63/1.1; 138/110; 138/127

[58] Field of Search ..... 63/1.1, 2, 20; D11/17, D11/19, 20, 25; 138/127, 110

[56] References Cited

U.S. PATENT DOCUMENTS

| | | | |
|---|---|---|---|
| 253,587 | 2/1882 | Crane | D11/40 |
| 260,095 | 6/1882 | Heckmann | 63/20 |
| 1,464,720 | 8/1923 | Mandalian | D11/17 |
| 1,666,033 | 4/1928 | Nittel | D11/20 |
| 2,305,644 | 12/1942 | Stone | 138/127 |
| 2,962,050 | 11/1960 | Ramberg et al. | 138/127 |
| 4,345,624 | 8/1982 | Rider | 138/127 |
| 4,567,917 | 2/1986 | Millard | 138/127 |
| 4,954,126 | 9/1990 | Wallstén | 606/198 |
| 5,024,419 | 6/1991 | Mulvey | 138/127 |

FOREIGN PATENT DOCUMENTS

| | | | |
|---|---|---|---|
| 12835 | of 1849 | United Kingdom | D11/20 |

*Primary Examiner*—Richard E. Moore
*Assistant Examiner*—Michael Milano
*Attorney, Agent, or Firm*—Ladas & Parry

[57] ABSTRACT

The invention relates to novel articles of jewelry and to processes for manufacturing same.

An article of jewelry according to the invention, for example a pen or a lighter, comprises a rigid cylindrical body which is enveloped by a tubular braid composed of interwoven strips or filaments of precious or stainless metal. The braid is manufactured separately. It is then fitted over the rigid body, then stretched longitudinally and welded to the two ends of the body and the welds are covered with two rings.

One application is the manufacture of pens, lighters or of jewelry such as necklaces, bracelets, pendants, earrings, etc.

9 Claims, 2 Drawing Sheets fig.1
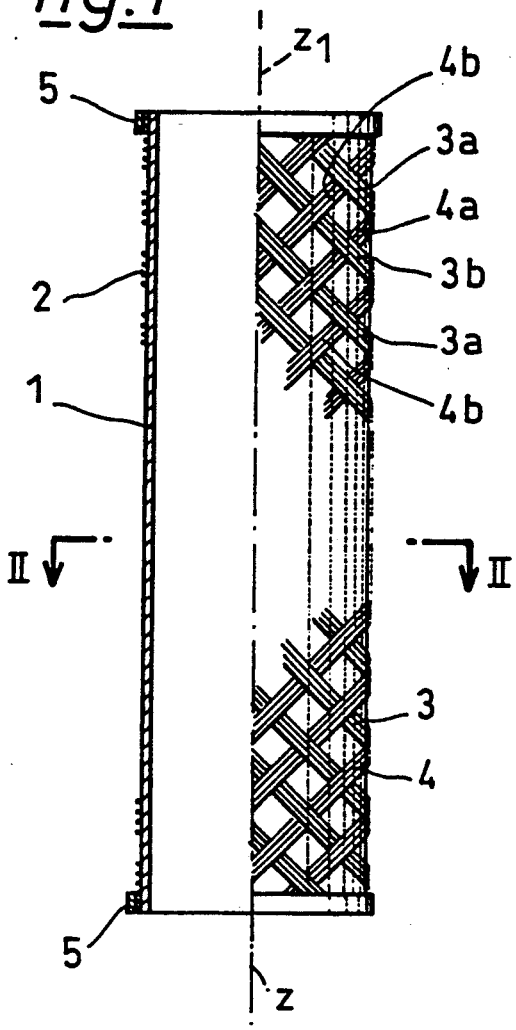
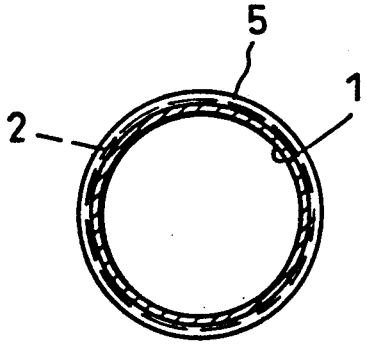
fig.2
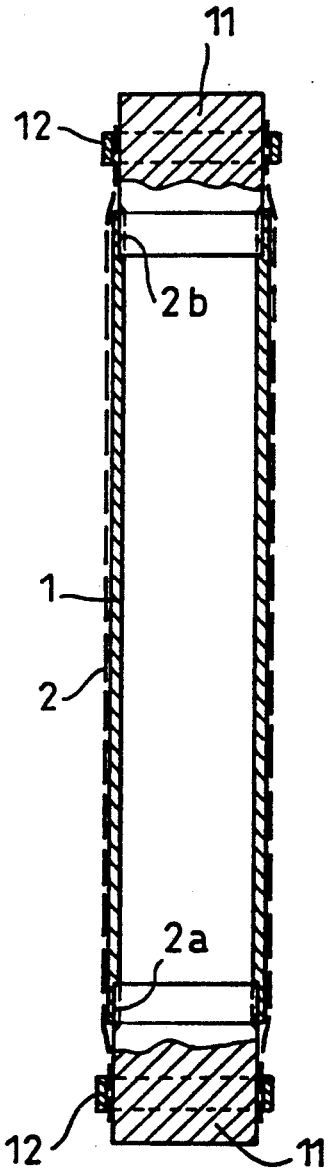
fig.5

ARTICLES OF JEWELRY AND PROCESS FOR MANUFACTURING SAME

FIELD OF THE INVENTION

The present invention relates to articles of jewelry and to processes for manufacturing same.

The technical sector of the invention is that of the manufacture of certain articles of jewelry, such as, for example, pens, lighters, bracelets, necklaces, ear-rings, pendants, etc . . .

BACKGROUND OF THE INVENTION

Tubular metallic braids are known which are composed of interwoven metal filaments or strips and machines are also known for industrially manufacturing such tubular braids. Such braids are used in particular for sheathing flexible tubes in order to increase their resistance to pressure and to protect them mechanically.

Metallic braided sheathes are also used for enveloping electric cables in order to protect them mechanically and also to form an electrical screen which is at the potential of earth or ground.

The present invention proposes a novel application of tubular metallic braids.

It is an object of the present invention to provide articles of jewelry, i.e. articles composed of precious metals such as gold, silver, platinum or stainless metals which present an ornamental and original outward appearance and which may be manufactured industrially, using a relatively low weight of precious metal.

SUMMARY OF THE INVENTION

This object is attained by means of articles of jewelry which comprise a tubular braid composed of interwoven strips or filaments of precious or stainless metals, which braid constitutes at least a part of the visible surface of said article of jewelry.

The articles of jewelry according to the invention advantageously comprise a braid composed of interwoven strips, in which each strip is constituted by a plurality of identical, juxtaposed filaments of precious or stainless metal.

According to a preferred embodiment, the articles of jewelry according to the invention comprise a tubular braid which is composed of interwoven filaments or strips of various colours.

According to a preferred embodiment, an article of jewelry according to the invention comprises a rigid cylindrical body and a tubular sheath which envelops said rigid body and which is constituted by a tubular braid, formed by interwoven strips or filaments or precious or stainless metals, which tubular braid is fixed to said rigid body by its two ends, being maintained under tension, with the result that it is applied against said rigid body and said interwoven strips form therebetween free spaces through which said rigid body is visible.

A process for manufacturing an article of jewelry according to the invention comprising a rigid cylindrical body, comprises the following successive operations:

making a tubular braid formed by strips or filaments of precious or stainless metals on a cylindrical mandrel having a diameter slightly greater than the diameter of said cylindrical body;

removing said braid from said mandrel;

fitting said braid on said cylindrical body;

longitudinally stretching said braid, which has for its effect to reduce the diameter thereof and causing it to be applied against said cylindrical body;

fixing the two ends of said braid, maintained taut, to said cylindrical body;

and engaging around each of the ends of said braid a metal ring which is welded on said body and/or on said braid.

The invention results in novel articles of jewelry, particularly pens, lighters or other articles comprising a rigid cylindrical body, of circular or ovalized section, which body is enveloped in a sheath constituted by a tubular braid formed by interwoven strips or filaments of precious or stainless metals and preferably in various alternating colours, which gives these articles an original, ornamental outward appearance.

These articles of jewelry present the advantage of being able to be manufactured industrially for a relatively moderate cost.

In fact, machines are known, capable of industrially manufacturing a metal braid on a cable or on a tube and it is therefore easy industrially to manufacture tubular braids composed of filaments or strips of precious or stainless metals.

Moreover, the metal braids present the property of being easily deformable.

In particular, they may be drawn, which makes it possible to reduce their diameter or their transverse dimension.

They may also be manufactured on cylindrical mandrels having a transverse section other than circular, for example an oval transverse section.

In order to manufacture articles of jewelry such as for example pens or lighters which comprise a rigid cylindrical body having a circular or oval transverse section which it is desired to envelop in a tubular braid, a tubular braid may therefore firstly be manufactured industrially on a mandrel whose transverse section is similar to that of the cylindrical body and of slightly greater dimensions, so that it is easy to engage the cylindrical body inside the braid without requiring any precise machining, the tubular braid is then stretched longitudinally so that its transverse section is reduced and it is applied against the rigid tubular body, and the braid is then fixed to the body for example by welding the two ends of the tubular braid to the rigid body.

This process for assembling a tubular braid on a rigid body presents, moreover, the advantage that extension of the tubular braid causes diamond-shaped openings to appear between the strips or filaments which move apart from one another and the rigid body is visible through these openings, this contributing to giving the article of jewelry an original outward appearance.

In the case of a pen or lighter which is held between the fingers, the latter are in contact with the tubular braid which envelops the body of the article, so that the skin penetrates slightly in the openings of the braid, hence a very good adherence which avoids the risks of sliding in the fingers.

The articles of jewelry according to the invention may also be jewels such as bracelets, necklaces, pendants or ear-rings of which a part is constituted by a tubular braid composed of interwoven filaments or strips of precious metal.

The presence of a tubular braid reduces wear of the rigid body that it envelops and enables the surface beauty to be maintained for a longer time.

BRIEF DESCRIPTION OF THE DRAWINGS

The invention will be more readily understood on reading the following description with reference to the accompanying drawings, in which:

FIG. 1 shows an axial half-section and a half-view of the outside of a pen body according to the invention.

FIG. 2 is a transverse section along II—II of FIG. 1.

FIG. 5 shows an axial section of an article in the course of manufacture.

DETAILED DESCRIPTION OF THE DRAWINGS

Figure 3:
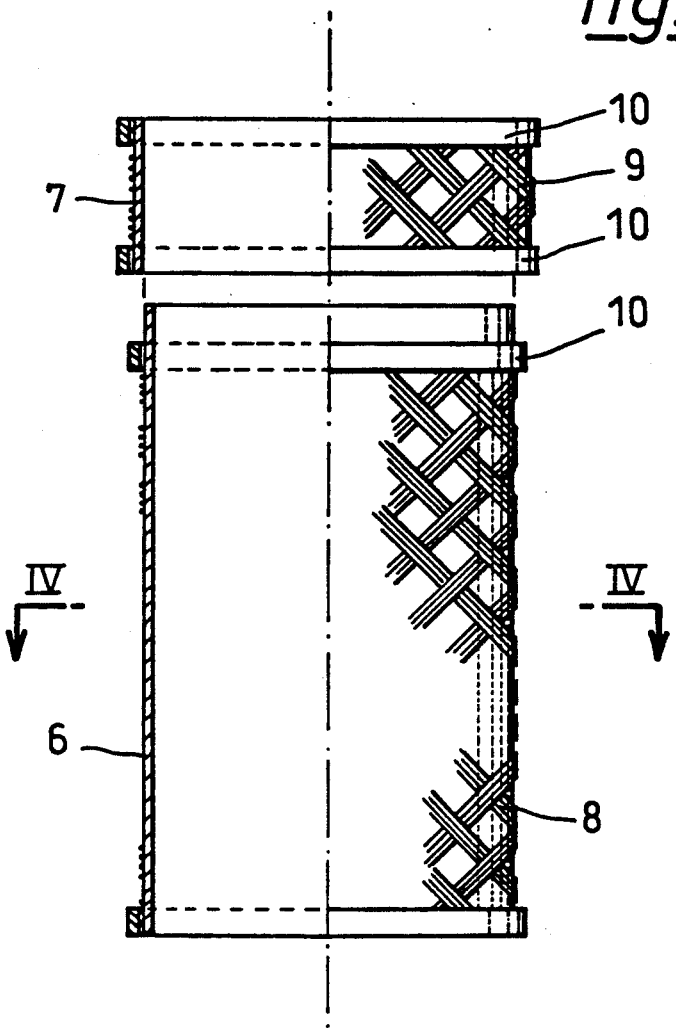
FIG. 3 shows an axial half-section and a half-view of the outside of a lighter according to the invention.

Referring now to the drawings, FIGS. 1 and 2 show a pen which comprises a rigid cylindrical body 1 having a circular section. It is question of a pen sold in a jeweller's and the body 1 is made of precious metal or gold-plated metal.

The body 1 contains the ink reservoir and an internal mechanism which are not shown.

The cylindrical body 1 is enveloped over the whole of its length by a sheath 2 which is a tubular braid composed of filaments or strips of precious or stainless metal, which are disposed in several directions and which are interlaced or interwoven.

FIG. 1 shows a preferred embodiment, comprising strips 3 parallel to one direction and strips 4 parallel to another direction, each strip being constituted by a plurality of identical, juxtaposed small filaments, having a very small diameter, for example a diameter of 0.2 mm, so that the weight of precious or stainless metal per unit of length of the braid is relatively low, of the order of 5 to 10 g for the whole of the braid adorning the pen.

The strips having the same direction are alternately in two different colours. For example, strips 3 comprise golden-coloured strips 3*a* which alternate with silver-coloured strips 3*b*.

Similarly, strips 4 alternately comprise strips 4*a* of one colour and strips 4*b* of another colour and these colours may be respectively identical to the colours of strips 3*a* and 3*b* or different from these colours.

These alternating colours give the braid which constitutes the major part of the visible surface of the pen, an original and ornamental outward appearance.

The two ends of the tubular braid 2 are fixed on the ends of the rigid body 1, for example by welding.

These ends are advantageously hidden by a ring 5 which surrounds each end of the body 1 and which is welded on the body and/or on the braid.

Figure 4:
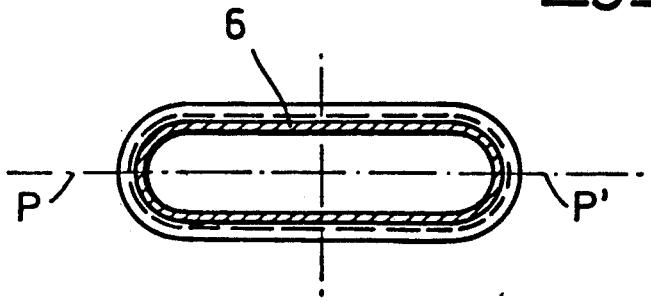
FIG. 4 is a transverse section along IV—IV of FIG. 3.

FIGS. 3 and 4 show a lighter which comprises a rigid cylindrical body 6 having an oval transverse section which contains the fuel reservoir and the mechanism of the lighter (not shown).

This lighter further comprises a cap 7 likewise presenting a cylindrical rigid body which fits on body 6.

Body 6 and cap 7 are each enveloped in a sheath 8, 9 which is a tubular braid composed of interwoven strips or filaments of precious or stainless metal.

The composition of braids 8, 9 is identical to that of braid 2. They differ from the latter solely by the oval shape of the transverse section which is obtained by making braids 8 and 9 on an oval mandrel. The two ends of each braid 8, 9 are fixed to the rigid body which is enveloped by the braid and are covered by a ring 10.

The upper ring 10 of the lighter body 6 is slightly recessed with respect to the upper end of the body to allow the cap 7 to fit on the body 6.

A process for manufacturing a pen according to FIGS. 1 and 2 comprises the following operations.

A tubular sheath is firstly manufactured, composed of filaments of precious or stainless metal having a diameter of the order of 0.1 to 0.2 mm, which are braided. This operation is effected on a machine of the type such as used for making braided sheaths for enveloping electrical cables or flexible tubes.

The tubular sheath is composed for example of interwoven strips, each strip being composed of a plurality of identical, juxtaposed filaments. The strips are disposed for example in two directions. For example, the braid comprises strips 3 which are wound in parallel helices rotating in one direction and strips 4 which are wound in parallel helices, of the same pitch and in a direction opposite the direction of helices 3. In this way, each strip 3 successively intersects strips 4, passing alternately above and below the successive strips 4, thus being interwoven and interlaced.

The tubular braid is made by winding the strips around a cylindrical mandrel whose diameter is slightly greater than the diameter of the rigid body 1 of the pens.

The successive strips of the same direction may be juxtaposed or slightly moved apart from one another and, in that case, the braid comprises diamond-shaped openings which are defined by four interwoven strips.

Once the braid is made, it is removed from the mandrel of the machine on which it was made, and it is cut into sections 2 having a length equal to or less than the length of the rigid bodies 1.

FIG. 5 shows the following step.

Pen bodies 1 generally comprise a female thread 2*a*, 2*b* at each of their ends.

There is screwed on each end of the body 1 a small threaded endpiece 11 comprising a male thread which is screwed in the female thread of the body. These endpieces are composed of a material which withstands the temperature of the welding oven. For example, threaded endpieces made of graphite or ceramics are used. These endpieces have for example a length of the order of a centimeter and they project on each side of the body 1.

A pen body 1 fitted at its two ends with an endpiece 11 is then introduced into each section of braid 2, previously cut out to the length of the pen body.

This operation presents no difficulty since the tubular braid has an inner diameter which corresponds to that of the mandrel on which it was made and which is greater than that of the pen body.

The tubular braid 2 is then stretched longitudinally, so that it is drawn, covering the endpieces 11, and its internal diameter decreases.

It is stretched until it is firmly applied against the outer surface of the rigid body 1. The two ends of the tubular braid 2 under tension are then fixed to the two endpieces 11 by any fastening means, for example by clip-shaped collars 12.

Once the taut braid is fixed around the body, welding paste, which corresponds to the nature of the metals constituting the braid and the body 1, for example gold paste in the case of body 1 being made of gold or gold-plate and braid 2 being made of gold filaments, is applied on the braid, around the two ends of the body 1.

Body 1 bearing the braids coated with welding paste is then introduced into a welding oven, which results in the braid being welded to the ends of the body 1.

The action of the heat on the braid also has for its effect to anneal the braid and therefore to reduce the internal tensions in the braid which tended to return it to its initial state.

The body 1 bearing the braid welded thereto is removed from the oven, the clips 12 as well as the end-pieces 11 are removed and the excess lengths of the braid are cut, i.e. those parts projecting beyond the ends of body 1. A ring 5 which was internally coated with welding paste is then fitted on each end of the braid and the body is again introduced into an oven to weld the rings on the ends of the braid. The duration of the second dwell time in the oven is shorter than the duration of the first, in order to avoid melting the weld of the braid on body 1.

A lighter according to FIGS. 3 and 4 is manufactured with the same sequence of operations, but this sequence is repeated for body 6 and for cap 7. The only difference resides in the fact that the tubular braid is made on a mandrel having an oval section corresponding to the section of the lighter.

FIGS. 1 to 4 show articles of jewelry comprising a rigid cylindrical body having a solid wall. It is specified that, in the case of jewelry such as bracelets or necklaces, the rigid body may be in the form of open-work or constituted by longitudinal strips which maintain the braid taut.

What is claimed is:

1. In an article of jewelry, the improvements comprising a rigid body and a tubular sheath longitudinally about said rigid body, said sheath being a braid formed by interwoven metal filaments that defines spaces therebetween and having longitudinally opposite ends fixed to said rigid body to maintain an amount of tension in said braid effective to press said braid radially against said rigid body, said spaces making portions of said rigid body visible through said braid all along and about said rigid body between said longitudinally opposite ends of said sheath.

2. The article of jewelry according to claim 1, wherein said filaments of said braid form interwoven strips, each of said strips being composed of a plurality of identical filaments made of precious metals juxtaposed to one another.

3. The article of jewelry according to claim 1, wherein said braid forms interwoven strips of several colors.

4. The article of jewelry according to claim 1, wherein said rigid body is a pen and said ends of said sheath are welded to said body and covered by rings.

5. The article of jewelry according to claim 1, wherein said rigid body is a tubular lighter and further comprising a cap that fits on said lighter, said ends of said sheath being welded to said lighter and covered by rings.

6. The article of jewelry according to claim 1, wherein said rigid body is an oblong lighter and further comprising a cap that fits onto said lighter, said ends of said sheath being welded to said lighter and covered by rings.

7. The article of jewelry according to claim 1, wherein said rigid body is an oblong cap for a lighter and said ends of said sheath are welded to said cap and covered by rings.

8. The article of jewelry of claim 1, wherein said filaments of said braid form interwoven strips, each strip being composed of a plurality of identical filaments made of stainless steel juxtaposed to one another.

9. The lighter according to claim 5, wherein said a cap is enveloped in a tubular braid having ends that are welded to said cap and which are covered by rings.

* * * * *